United States Patent [19]

Sigott et al.

[11] 3,972,429

[45] Aug. 3, 1976

[54] DIVIDING CUTTING MACHINE

[75] Inventors: Siegfried Sigott; Hubert Schwelberger; Herbert Obermaier; Alfred Zitz, all of Zeltweg, Austria

[73] Assignee: Vereinigte Osterreichische Eisen-und Stahlwerke - Alpine Montan Aktiengesellschaft, Austria

[22] Filed: June 12, 1975

[21] Appl. No.: 586,344

Related U.S. Application Data

[63] Continuation of Ser. No. 374,388, June 28, 1973, abandoned.

[30] Foreign Application Priority Data

June 30, 1972 Austria ..... 5639/72

[52] U.S. Cl. ..... 214/130 R; 299/64

[51] Int. Cl.[2] ..... B66C 23/00

[58] Field of Search ..... 180/5 R; 212/145; 280/150.5; 214/140, 762, 130; 198/10; 299/64, 65, 66, 67

[56] References Cited

UNITED STATES PATENTS 3,095,080 6/1963 Wagner ..... 198/10

3,499,684 3/1970 McCracken ..... 299/64

*Primary Examiner*—Robert J. Spar

*Assistant Examiner*—Ross Weaver

*Attorney, Agent, or Firm*—Cushman, Darby & Cushman

[57] ABSTRACT

Crawler track means are mounted on and adapted to carry the frame of the machine and have a tread having a rear end. A loader is mounted on and protrudes forwardly beyond the forward end of said frame and has a scooping lip which has the configuration of an arrowhead and is formed with forward edges defining a plane. The loader is forwardly and downwardly inclined toward the scooping lip and is adapted to be raised and lowered relative to the frame and crawler track means and adapted to assume a lowermost position. When the loader is in said lowermost position, said plane defined by said forward edges of said scooping lip is tangent to said crawler track means behind the center of the length of said crawler track means and spaced from said tread before the center of the length of said crawler track means.

9 Claims, 3 Drawing Figures

DIVIDING CUTTING MACHINE

Figure 1:
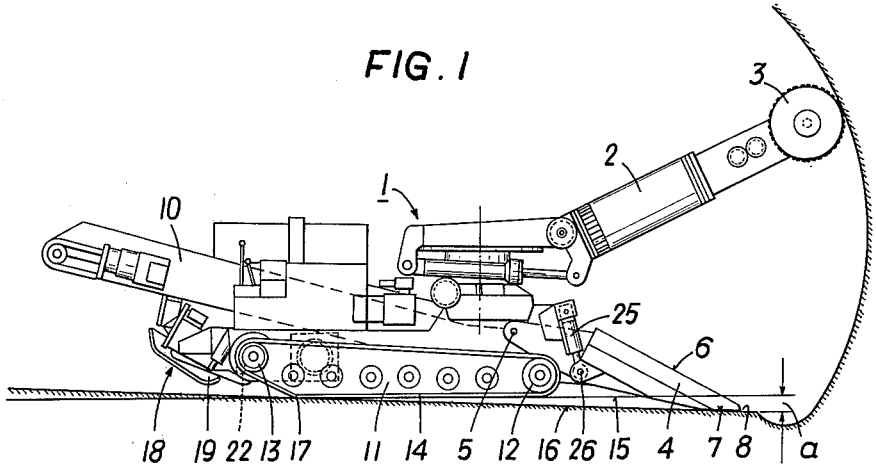

This is a continuation of application Ser. No. 374,388 filed June 28, 1973 now abandoned.

Dividing cutting machines are usually provided with crawler tracks, which are operated to move the cutting tool, which is mounted on a pivoted jib arm, into the face to be cut to the depth which is desired. From this position, the jib arm performs pivotal movements in vertical directions whereas the cutting machine remains in place. In front of the cutting machine, below the jib arm, a loader is provided, which consists of a ramp that can be raised and lowered and by which the material which has been cut off is fed to a conveyor. As the cutting tool is driven into the face to the depth which is required, the reaction forces which are produced can be substantially taken up by the propulsion forces of the crawler tracks without difficulty. On the other hand, when the jib arm performs a pivotal working movement, it is difficult for the crawler tracks to take up the reaction forces, and the cutting machine mounted on the crawler tracks often yields laterally or bucks about a transverse axis under the action of the working pressure.

The invention relates to such a dividing cutting machine which is provided with crawler tracks and with a loader which has a scooping lip having the configuration of an arrowhead and can be raised and lowered and forms a ramp leading to the floor, and the invention resides essentially in that when the loader is in its lowermost position the edges of the scooping lip are in a plane which is tangent to the crawler tracks at points disposed behind the center of the length of the crawler tracks, preferably at the rear ends of the treads of the crawler tracks, and is spaced from those portions of the treads of the crawler tracks which are disposed before the center of the length of the crawler tracks. The scooping lip having the configuration of an arrowhead is formed in that the ramp of the loader has a shape which is similar to a roof so that the loading action of the loader is promoted. In this arrangement known per se, the scooping lips having the configuration of an arrowhead are in snug contact with the floor only in a predetermined position of the loader. In accordance with the invention this position is selected so that when the scooping lips are in snug contact with the floor the forward portions of the crawler tracks are lifted from the floor. As a result, the foremost point of support for the cutting machine is advanced by the length of the loader and the rearmost point of support for the cutting machine is disposed near the rear portion of the crawler tracks. This arrangement ensures a high stability of the cutting machine during operation. In this position of the cutting machine the same can be advanced by the crawler tracks although the loader is lowered so that the scooping lips scrape the floor. In an arrangement which has proved desirable, the tip of the scooping lip lies about 80 millimeters below the plane determined by the treads of the crawler tracks.

The floor may be so uneven that even when the loader is lowered as far as possible the scooping lips are insufficiently forced against the floor. For this reason, the invention contemplates the use of a supporting device which is provided adjacent to the rear ends of the crawler tracks and preferably slightly behind the tracks and which can be lowered. When the floor is so uneven that the cutting machine rests only on the scooping lips and on the supporting device and the crawler tracks are lifted from the ground it will obviously be impossible to move the cutting machine when the supporting device is lowered but the machine has a high stability in its operating position. The supporting device suitably comprises a preferably skidlike shoe, which extends within the width of the cutting machine and is pivoted to a lever which in turn is pivoted to the frame. In this way a support at the rear of the machine is ensured in a width which is approximately as large as the width of the crawler tracks. For higher safety, the rear supporting device may be extended even when the rear ends of the crawler tracks lie on the floor when the loader is lowered; in this case the skidlike shoe affords the advantage that the cutting machine can travel on the crawler tracks even when the supporting device is lowered. When the machine is used on strongly undulating floor, the same may be relatively low adjacent to the supporting device even if the crawler tracks rest on the floor. For this reason the arrangement is suitably such that the supporting device can be lowered to a large depth, e.g. as far as 200 millimeters below the plane which is defined by the treads of the crawler tracks. In this arrangement, the crawler tracks may be lifted from the floor, e.g. for maintenance work.

Figure 2:
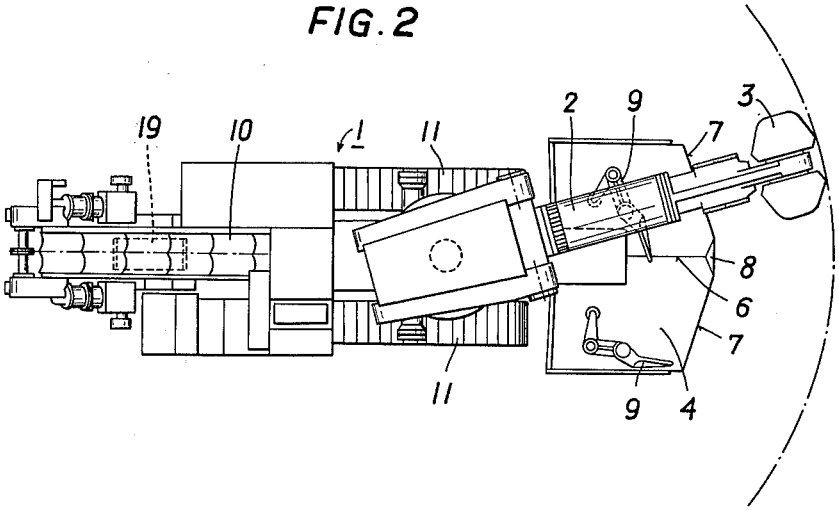

An embodiment of the invention is shown diagrammatically and by way of example on the accompanying drawings, in which FIG. 1 is a side elevation and FIG. 2 a top plan view of the dividing cutting machine.

Figure 3:
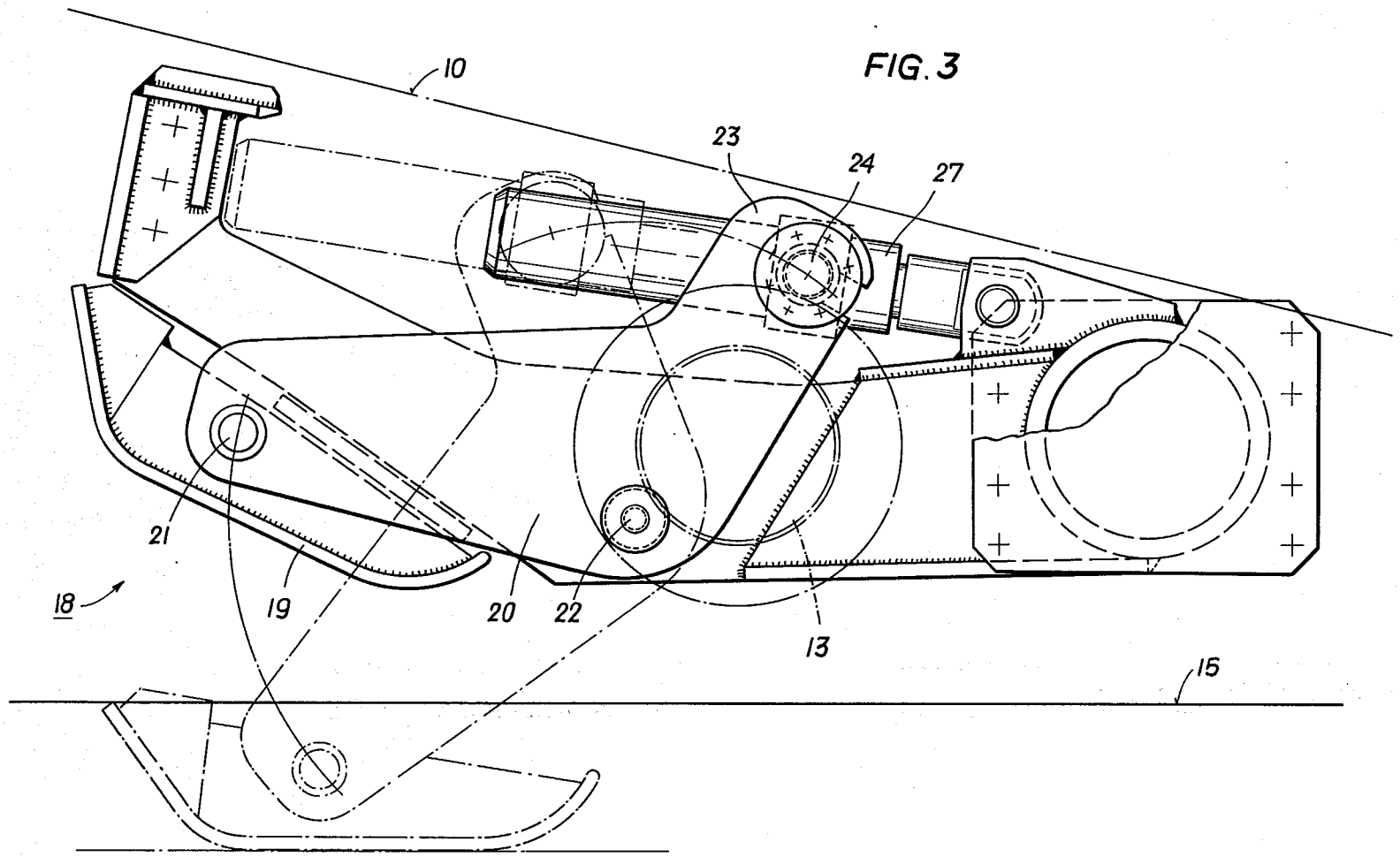

FIG. 3 shows a detail.

A dividing cutting machine comprises a frame 1. A jib arm 2 carries a cutting tool 3 and is connected to the frame for pivotal movements in all direction. A loader 4 is disposed below the jib arm 2 and is pivoted to the frame 1 for a vertical pivotal movement about a horizontal axis 5. The loader 4 has a surface which is similar to a roof having a ridge 6. This rooflike surface terminates in a scooping lip 7, which has the shape of an arrowhead and at its foremost end forms a tip 8. The usual raking arms 9 similar to claws of lobsters serve to move the cut material on the loader to a belt conveyor or scraper flight conveyor 10. The cutting machine travels on crawler tracks 11, which are driven by forward sprockets 12 and rear sprockets 13.

The treads 14 of the crawler tracks 11 define the plane 15. The loader can be lowered to such an extent that its scooping lip 7 inclusive of its tip 8 is disposed below the plane 15. The distance *a* by which the tip 8 lies below the plane 15 is the lowermost position of the loader amounts to about 8 centimeters. The arrangement is such that the scooping lip which is similar to an arrowhead lies in a plane 16 which is tangent to the rear ends 17 of the treads of the crawler tracks 11. In this arrangement, when the loader 4 is lowered as far as possible so that the cutting machine rests on the scooping lip 7, which is similar to an arrowhead, and on the rear ends 17 of the crawler tracks 11, the scooping lip lies snugly on the floor which lies in the plane 16. This results in a good scraping action. The cutting machine, which e.g. can be used for coal-cutting or cutting tunnels is thus stabilized in its working position, in which a force is exerted on the machine by the jib arm 2; nevertheless the cutting machine can be advanced on the rear ends 17 of the crawler tracks 11 while the scooping lip 7 scrapes on the floor 16.

A supporting device 18 is disposed behind the crawler tracks 11 and comprises a skidlike shoe 19, which is pivoted on a pivot 21 to a double-armed lever 20 (see FIG. 3). The lever 20 is pivoted on a pivot 22 to the frame 1 adjacent to the rear drive sprockets 13 for the crawler tracks 11. A hydraulic actuator 27 is connected at 24 to the second arm 23 of this lever. As is indicated in dotted lines in FIG. 2, the supporting device 18 and particularly the shoe 19 is disposed in the middle of the width of the vehicle behind the crawler tracks 11. The supporting device 18 can be lowered so that the rear point of support is displaced further to the rear and the stability of the cutting machine in its working position is improved. Because the floor may be very uneven, the supporting device 18 is adapted to be lowered to a relatively large depth. For instance, the shoe 19 can be lowered as far as 200 millimeters below the plane of travel 15 defined by the crawler tracks 15.

The pivot 5 of the loader 4 is disposed behind the forward reversing sprockets 12 of the crawler tracks 11. The loader 4 can be lowered by a hydraulic actuator 25, which is connected to the loader 4 at 26. Because the pivot 5 of the loader 4 is disposed on the rear of the forward reversing sprockets of the crawler tracks and the actuator 25 is connected to the loader 4 at the point 26 which is spaced a relatively large distance from the pivot 5, the exertion of strong lifting forces on the loader 4 is promoted. The distance between the connection 26 to the pivot 5 connecting the loader to the frame is at least one-fourth and suitably about one-third of the entire overhang of the loader 4 measured from the pivot 5 to the tip 8 of the scooping lip 7.

We claim:

1. A dividing cutting machine comprising:

a frame having a forward end, crawler track means mounted with said frame for carrying said frame, said crawler track means including a tread with a rear end and rear portion, and a forward portion, the bottom of the tread defining a first plane, a loader for loading ore or the like, said loader mounted on and protruding forwardly beyond the forward end of said frame and having a scooping lip with forward edges that have the configuration of an arrowhead, said forward edges defining a second plane, and said loader being forwardly and downwardly inclined toward said forward edges of said scooping lip, and means for exerting a downwardly directed force on said loader sufficient to lift said forward portion of said tread from a first position wherein said second plane is generally an extension of said first plane and said forward portion of said tread touches the ground, to a second position wherein said second plane is tangent to said tread in said rear portion thereof, said forward portion of said tread being spaced above said second plane and the ground, so that said machine may move along the ground while said scoop is in its second position so that it is not necessary to stop and lift the scoop during advancement of said machine.

2. A dividing cutting machine as recited in claim 1 further comprising a supporting device mounted on said frame and dispose adjacent to said rear end of said tread and for raising said frame and crawler track means when lowered below said tread.

3. A dividing cutting machine as recited in claim 2 wherein said supporting device is disposed behind said crawler track means.

4. A dividing cutting machine as recited in claim 2 wherein said supporting device comprises a shoe disposed within the width of said machine, and a lever pivotally connected to said shoe and said frame.

5. A dividing cutting machine as recited in claim 4 wherein said shoe is skidlike.

6. A dividing cutting machine as recited in claim 1 wherein said forward edges of said scooping lip have a tip portion at the foremost end thereof, and wherein said means for exerting a downwardly directed force of said loader may move said tip portion so that it is about 80 millimeters below said first plane in said second position of said tread.

7. A dividing cutting machine as recited in claim 6 wherein said crawler track means comprises forward and rear reversing sprockets mounted on respective axes in said frame and crawler tracks forming said tread and trained around said forward and rear reversing sprockets, said loader being pivoted to said frame on an axis which is disposed behind the axis of said forward reversing sprockets.

8. A dividing cutting machine comprising:

a frame having a forward end, crawler track means mounted with said frame for carrying said frame, said crawler track means including a tread with a rear end and rear portion, and a forward portion, the bottom of said tread defining a first plane, a loader for loading ore or the like, said loader mounted on and protruding forwardly beyond the forward end of said frame and having a scooping lip with forward edges that have the configuration of an arrowhead, said forward edges defining a second plane, and said loader being forwardly and downwardly inclined toward said forward edges of said scooping lip, and means for exerting a downwardly directed force on said loader sufficient to lift said forward portion of said tread from a first position wherein said second plane is generally an extension of said first plane and said forward portion of said tread touches the ground, to a second position wherein said second plane is tangent to said tread in said rear portion thereof, said forward portion of said tread being spaced above said second plane and the ground, said means for exerting a downwardly directed force comprising hydraulic cylinder-piston systems connected to said frame and said loader and extending downwardly from said frame, said loader being pivoted to said frame on a pivotal axis, and said hydraulic cylinder-piston systems being connected to said loader at a point thereon at least one-fourth the distance from said pivotal axis to the front tip of said loader.

9. A dividing and cutting machine as recited in claim 8 wherein said distance of the point of connection of said hydraulic cylinder-piston systems to said loader is approximately one-third the distance from said pivotal axis to the front tip of said loader.

* * * * *